US005439108A

United States Patent [19]

Lackie

[11] Patent Number: 5,439,108

[45] Date of Patent: Aug. 8, 1995

[54] COMPARTMENTALIZED TOOL BOX

[76] Inventor: Edward J. Lackie, 157 Vermont Ave., Ft. Myers, Fla. 33905

[21] Appl. No.: 240,455

[22] Filed: May 10, 1994

[51] Int. Cl.[6] ..... B65D 6/04

[52] U.S. Cl. ..... 206/373; 206/499; 220/527; 220/528; 220/771

[58] Field of Search ..... 190/16, 35; 206/44.12, 206/45.16, 372, 373, 499, 546, 566, 585; 217/7, 10; 220/4.26, 23.6, 23.82, 408, 410, 503, 505, 527, 528, 771; 229/120.37; 312/312, 902

[56] References Cited

U.S. PATENT DOCUMENTS

| | | | |
|---|---|---|---|
| 1,570,963 | 1/1926 | Hamilton | 206/45.16 |
| 1,614,910 | 1/1927 | Yarder | 206/373 |
| 1,646,902 | 10/1927 | Diebold | 206/45.16 |
| 2,030,546 | 2/1936 | Sheffer | 206/45.16 |
| 2,247,341 | 6/1941 | Anderson | 229/120.37 |
| 2,718,326 | 9/1955 | Le Blanc | 206/499 |
| 3,250,283 | 5/1966 | Reinfeld . | |
| 3,516,596 | 6/1970 | Madden et al. | 206/499 |
| 3,627,122 | 12/1971 | Garbe, Jr. . | |
| 3,926,308 | 12/1975 | Sullivan . | |
| 4,000,841 | 1/1977 | Bächli . | |
| 4,662,515 | 5/1987 | Newby, Sr. | 312/902 |
| 4,911,295 | 3/1990 | Venegoni | 206/372 |
| 5,004,103 | 4/1991 | Connors et al. . | |
| 5,011,013 | 4/1991 | Meisner et al. | 206/499 |
| 5,117,979 | 6/1992 | Brightbill | 206/373 |

*Primary Examiner*—Jimmy G. Foster

[57] ABSTRACT

A tool box having a plurality of trays stackable therein provides a snug fit for each of the trays located therein so as to prevent any lateral movement of the trays as the tool box is moved. Further, a topmost tray engages the lid of the tool box when the lid is closed, thereby preventing any vertical movement of the trays as the tool box is moved. In this manner, the contents of each compartment of each tray remain in place even if the tool box is dropped as long as the lid does not open. Two latches on the front of the tool box prevent the lid from opening as the tool box is moved about.

2 Claims, 1 Drawing Sheet

COMPARTMENTALIZED TOOL BOX

BACKGROUND OF THE INVENTION

1. FIELD OF THE INVENTION

The present invention relates to tool box having compartments located therein for storing a variety of hardware items in the various compartments. More specifically, the device of the present invention pertains to such a tool box having stackable trays located therein which are placed one on top of another.

2. DESCRIPTION OF THE PRIOR ART

U.S. Pat. No. 3,250,283 issued May 10, 1966 to William H. Reinfeld discloses an article handling and cleaning apparatus having a plurality of trays with handles located on the sides thereof, each tray being insertable into a partition member of a rack.

U.S. Pat. No. 3,627,122 issued Dec. 14, 1971 to Robert R. Garbe, Jr. discloses drug-carrying trays having compartments specifically designed for retaining labels and drugs. Each of the trays have a centrally located hole in the center for allowing a rod supported by a base to enter from the bottom end thereof. In this manner the trays are maintained in a stacked array.

U.S. Pat. No. 3,926,308 issued Dec. 16, 1975 to Lyle L. Sullivan discloses a tool carrying case having a lid hingeably attached to one end thereof. A tray is also hingeably attached to the one end of the tool carrying case. With the tray lowered, the tool carrying case has two compartments located therein, one located below the tray, the other located between the space between the tray and the lid.

U.S. Pat. No. 4,000,841 issued Apr. 2, 1991 to Emil Bächli discloses a multicompartment, multi-level stacking carrier. A lower tray forms the base of the carrier and an upper tray forms the top cover for the carrier. The various trays are maintained in a stacked position by a pair of posts extending from the bottom tray and passing through each tray located above the bottom tray including the top tray to which a handle is attached over the posts.

U.S. Pat. No. 5,004,103 issued Apr. 2, 1991 to Peter J. Connors et al. discloses a tool storage box having a tray insertable therein. A lip portion within the box maintains the tray above the bottom of the tray. Articles may be place into holes located within the tray to suspend the articles, such as punches, above the bottom of the tray.

None of the above inventions and patents, taken either singly or in combination, is seen to describe the instant invention as claimed.

SUMMARY OF THE INVENTION

The tool box of the present invention is designed to accommodate a plurality of trays within an inner compartment in a stacked fashion. Each tray has a plurality of compartments located therein for storing items, with a central compartment having a handle for allowing a user to easily lift the tray out of the inner compartment or lower the tray into the inner compartment. The trays fit snugly within the inner compartment so that lateral movement of the trays is prevented as the tool box is moved about. Further, with the lid of the tool box closed, vertical movement of the trays is prevented since the height of each tray is established to allow the top portion of the topmost tray to engage the closed lid.

Accordingly, it is a principal object of the invention to provide a tool box having a plurality of trays stored therein simply by stacking the trays within the inner compartment of the tool box.

It is another object of the invention to provide handles within a central compartment of each tray to allow a user to easily remove a top tray from the tool box or lower a tray into the tool box.

It is a further object of the invention to provide a snug fit for each tray located within the tool box so as to prevent lateral movement of the trays as the box is moved.

Still another object of the invention is to prevent any vertical movement of the trays as the tool box is moved by establishing the height of each tray so that a top portion of a topmost tray engages the lid when it is closed.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 2:
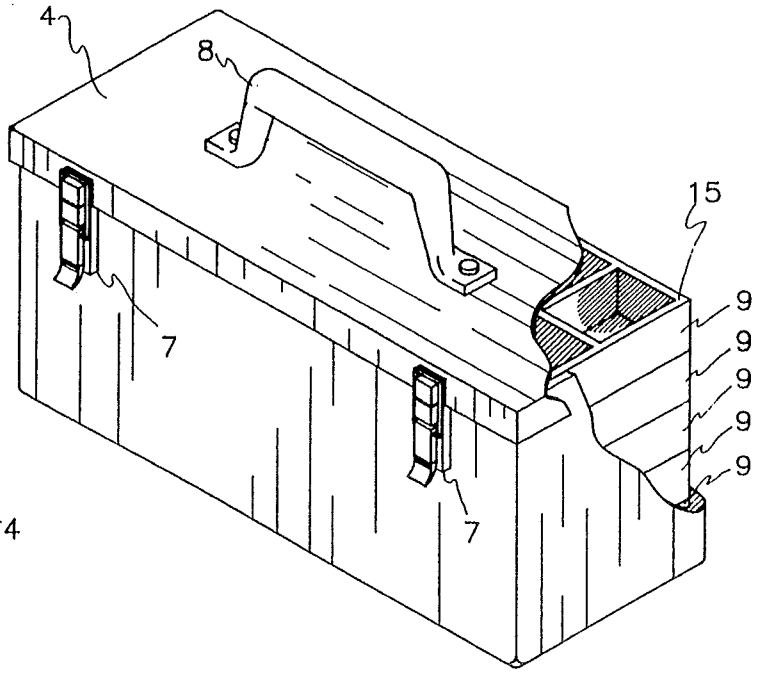
FIG. 2 is a perspective view of the tool box of the present invention with the lid thereof closed and a cutaway portion provided therein showing the position of the trays located within the inner compartment of the tool box.
Figure 1:
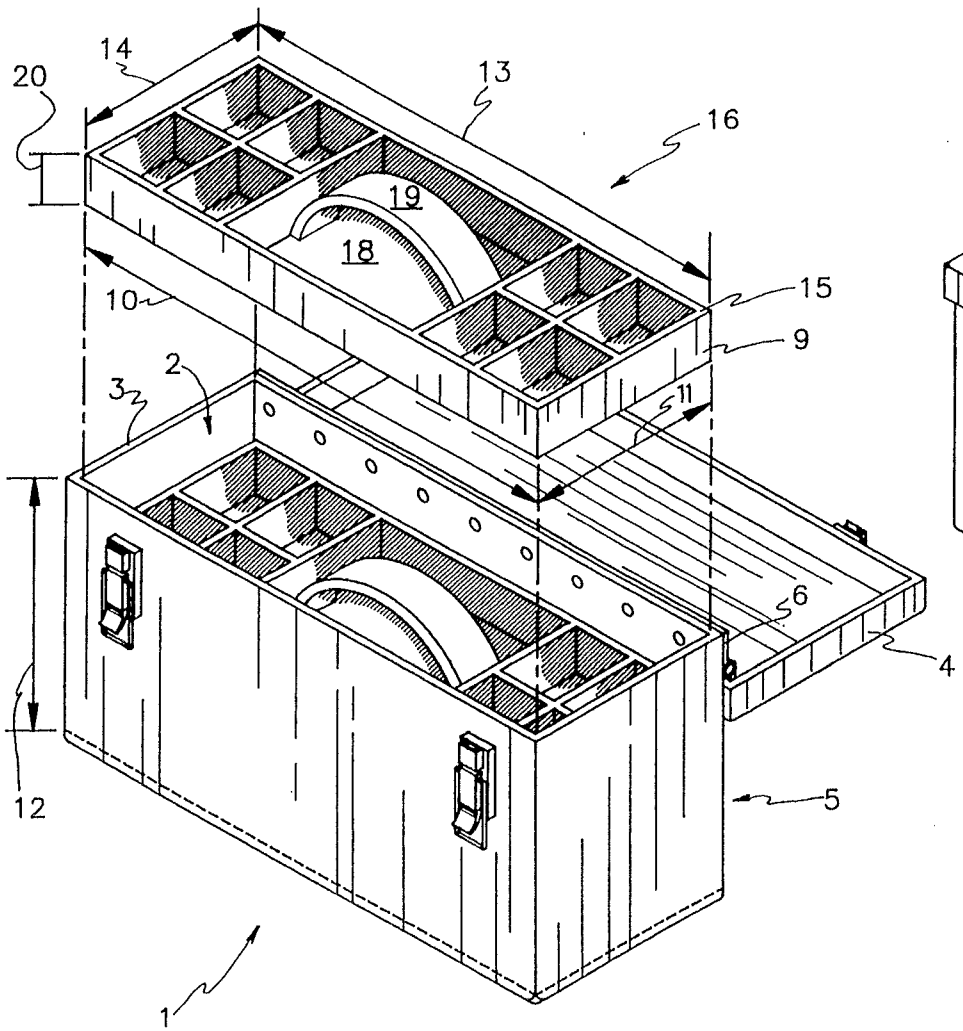
FIG. 1 is an exploded perspective view of the tool box of the present invention.

The tool box 1 of the present invention has an inner compartment 2 accessible to a user via an open top 3, as illustrated in FIG. 1. A lid 4 is attached to a side 5 of the tool box 1 by a hinge 6 so that the tool box 1 may be closed as shown in FIG. 2. Two latches 7 secure the lid 4 closed so that the lid 4 does not open when the tool box 1 is lifted by a user via the handle 8 which is attached to the top of the lid 4.

As illustrated in FIG. 1, a plurality of trays 9 are stored within the inner compartment 2 of the tool box 1. The inner compartment 2 has a predetermined length 10, width 11, and depth 12. Each of the trays 9 has a length 13 and width 14 substantially equivalent to the predetermined length 10 and width 11 of the inner compartment 2. In this manner, each tray 9 fits snugly within the inner compartment 2 preventing any lateral movement of the trays 9 while the tool box 1 is being moved.

Each tray has an open top 15 with a plurality of compartments 16 located within the tray, each accessible to a user via the open top 15. Each tray 9 also has a bottom 17 which forms the floor of the tray 9. As illustrated in FIG. 1, each tray has four compartments 16 located on the right of the tray 9 and four compartments 16 located on the left of the tray 9 with a central compartment 18. Within the central compartment 18 is a handle 19 so that the tray 9 may be carried. The height of the handle 19 is not greater than the height 20 of the tray 9 so that the handle 19 does not extend beyond the open top 15 of the tray 9.

As illustrated in FIG. 2, the height 20 of each of the trays 9 is predetermined so as to allow a predetermined number of trays 9 to be placed within the inner compartment 2 of the tool box 1 with a topmost tray 9 reaching the open top 3 of the tool box 1. As illustrated in FIG. 1, which is the preferred embodiment, there are five (5) trays 9 which may be stored within the tool box 1. The height 20 of each tray 9 is the same and is equivalent in magnitude to the predetermined depth 12 of the inner compartment 2 divided by the number of trays 9 stored therein. For example, if the depth 12 of the inner compartment 2 is ten inches (10″), the height 20 of each of the five (5) trays 9 is two inches (2″).

With each tray 9 located within the inner compartment 2 and the lid 4 of the tool box 1 closed, any contents within any of one of the compartments 16 of the trays 9 remain in that tray 9. Since the lid 4 completely covers the open top 3 of the tool box 1 and the open top 15 of the topmost tray 9 extends to the open top 3 of the tool box 1, the lid 4 also covers the open top 15 of the topmost tray 9, In this manner, the contents of the topmost tray 9 are maintained in their respective compartments 16. For each of the trays 9 located below the topmost tray 9, the bottom of the tray 9 thereabove covers the open top 15 of that tray 9. Since the height of each tray 9 is established so as to allow the trays 9 to fit inside the inner compartment 2 of the tool box 1 with the topmost tray 9 reaching the open top 3 of the tool box 1, as long as the lid 4 is closed and locked by the latches 7, there is no vertical movement of the trays 9 as the tool box 1 is raised and lowered. In this manner, even if the tool box 1 were dropped or tipped over, the contents of each of the trays 9 would remain in their respective compartments 16.

It is to be understood that the present invention is not limited to the sole embodiment described above, but encompasses any and all embodiments within the scope of the following claims.

I claim:

1. A compartmentalized container comprising:

a rectangular tool box having an open top with an inner compartment located therein, said inner compartment of said tool box having a first predetermined length, a first predetermined width, and a first predetermined depth, wherein said first predetermined depth extends from said open top of said rectangular tool box to a bottom thereof; and a predetermined number of trays, each having an open top with a plurality of compartments located therein, each of said predetermined number of trays having a second predetermined length and width substantially equivalent to said first predetermined length and width, respectively, and each of said predetermined number of trays further have a second predetermined depth equivalent to said first predetermined depth divided by said predetermined number;

wherein each of said predetermined number of trays include a handle;

wherein each of said predetermined number of trays include a centermost compartment, wherein said handle of each of said predetermined number of trays is located within said centermost compartment; and wherein each of said predetermined number of trays may be stacked within said inner compartment from a topmost tray to a bottommost tray, each of said predetermined number of trays fitting snugly therein preventing any lateral movement of said trays.

2. A compartmentalized tool box as claimed in claim 1, wherein said tool box includes a lid which fits over said open top of said tool box and said open top of said topmost tray, thereby preventing any contents located within any of said plurality of compartments of said topmost tray from exiting said open top of said tool box and said topmost tray, wherein any contents located within any one of said plurality of compartments of each of said plurality of trays located below said topmost tray is trapped inside said one of said plurality of compartments by a bottom portion of a tray located thereabove.

* * * * *